US005344003A

United States Patent [19]

Park

[11] Patent Number: 5,344,003

[45] Date of Patent: Sep. 6, 1994

[54] PACKAGING PAD PREVENTING WRINKLES OF CAPS WITH EYESHADES

[75] Inventor: Boo-Yl Park, Seoul, Rep. of Korea

[73] Assignee: Dada Corp., Seoul, Rep. of Korea

[21] Appl. No.: 51,501

[22] Filed: Apr. 22, 1993

[30] Foreign Application Priority Data

Feb. 22, 1993 [KR] Rep. of Korea ..... 1993-2403

[51] Int. Cl.[5] ..... B65D 85/18

[52] U.S. Cl. ..... 206/8; 206/476; 206/482; 206/495

[58] Field of Search ..... 206/482, 483, 477, 476, 206/486, 487, 488, 489, 495, 480, 8, 278; 211/113, 73, 72

[56] References Cited

U.S. PATENT DOCUMENTS 855,216 5/1907 Andersen ..... 206/336
4,957,204 9/1990 Dooley ..... 206/482 X
5,096,070 3/1992 Jaynes ..... 211/113 X
5,103,970 4/1992 Nielson et al. ..... 206/482 X
5,199,578 4/1993 Pendergraph et al. ..... 206/482 X

FOREIGN PATENT DOCUMENTS 490762 8/1938 United Kingdom .

*Primary Examiner*—Jacob K. Ackun, Jr.
*Attorney, Agent, or Firm*—Marshall & Melhorn

[57] ABSTRACT

This invention is for a packaging pad preventing wrinkles of caps with eyeshades. It is composed of many half-arc-shaped cutting portions to fix eyeshades, which are parts of caps, in an orderly manner, a supporting hole installed at one side of the pad which enables its hanging on the wall, and small holes installed at both ends of half-arc-shaped cutting portions to prevent ripping-off of the cutting portions.

4 Claims, 2 Drawing Sheets

PACKAGING PAD PREVENTING WRINKLES OF CAPS WITH EYESHADES

BACKGROUND OF THE INVENTION

1. Field of the Invention

The present invention relates to a packaging device for storing and displaying caps with eyeshades, and in particular, to a pad made from an elastic material which maintains the cap in spaced-apart relationship.

2. Description of the Prior Art

Caps with eyeshades are an important business in the Unites States and in countries throughout the world. Caps with eyeshades are worn during a variety of work related and sports related activities, and are used extensively as a promotional item. Caps are also worn by people of all ages as a fashion item.

Caps with eyeshades are boxed and transported from the point of manufacture to retail outlets in distant locations. One of the major problems encountered in transporting the caps is aligning and retaining the caps to prevent wrinkles and to minimize any bends or breaks in the eyeshades of the caps. When caps are packaged without a pad, the caps will shift within the box during transport and will be misaligned from the initial stacking of the caps. The weight of the caps within the box and of the other boxes stacked on top of or adjacent the box will cause a significant number of caps to be damaged in shipment such that the caps are rejected and returned by the retail outlets receiving the box of caps.

In addition to the problem of damage during transport, the manufacturer of caps also desire a quick and convenient means to display the caps at the retail outlet. A wall display is an effective means for displaying caps because the amount of floor space needed for the caps is reduced. Retailers desire a rugged display that is easy to mount and that will remain functional for an extended period of time.

SUMMARY OF THE INVENTION

In accordance with the present invention, there is provided a packaging pad made from a synthetic resin with high elasticity, the pad including a means for securing a plurality of caps with eyeshades to the pad in a fixed, spaced-apart relationship. The pad protects the caps during transport from the manufacturing plant to the retail location, and provides a convenient means for display the caps upon arrival at a retail outlet.

A series of half-arc slits are cut in the pad to facilitate the insertion of the caps. The slits are cut such that the shape of the slit conforms to the general shape of the junction of the body of the cap and the eyeshade portion of the cap. The elastic material used to form the pad permits the cutting portion, or tongue, to be flexed inward for insertion of the eyeshade of the cap, and then causes the cutting portion or tongue to return to its original position to secure and retain the caps in the pad. The retention means of the present invention maintains the caps in the desired position during transport and display of the caps.

An object of the present invention is to provide a low cost and efficient means for storing caps with eyeshades during transport.

A further object of the present invention is to provide a convenient means of displaying the caps at a retail outlet.

BRIEF DESCRIPTION OF THE DRAWINGS

For a better understanding of the invention, and to show how the same may be carried out into effect, reference will now be made, by way of example, with respect to the accompanying drawings, in which.

Figure 1:
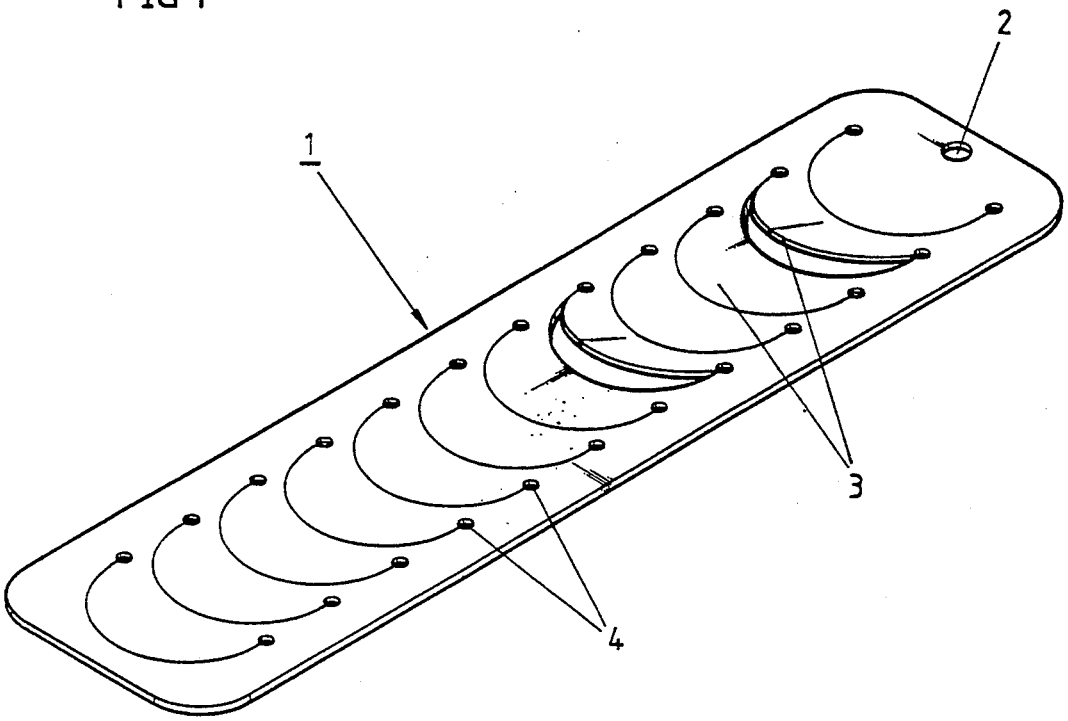
FIG. 1 is an overall perspective view of the invention.

In these drawings, Reference Numeral 1 is a packaging pad; Reference Numeral 2 is a supporting hole; Reference Numeral 3 is a half-arc-shaped cutting portion; and Reference Numeral 4 is a small hole on the pad.

DETAILED DESCRIPTION OF THE INVENTION

This invention is for a packaging pad preventing wrinkles of caps with eyeshades.

In the past, when a large quantity of caps with eyeshades are transferred and kept in a container, these caps are folded in two, lined up, and packed simply in a package. However, this method of packaging causes decrease in the quality of the goods because of outside impact and pressure when a large quantity of caps are transferred. Caps stored in a package become scattered and wrinkled because of this outside impact and pressure.

This invention is to prevent the above problems. In this invention, a packaging pad made of synthetic resin with comparably high elasticity having many half-arc-shaped cutting portions is used to firmly fix eyeshades which are parts of caps; a large quantity of caps are readily handled by a unit quantity; and increase in displaying effect and sales can be expected by fixedly holding a packaging pad with a certain number of caps on a wall or a display site. The details of the invention are explained below with reference to the accompanying figures.

Figure 2:
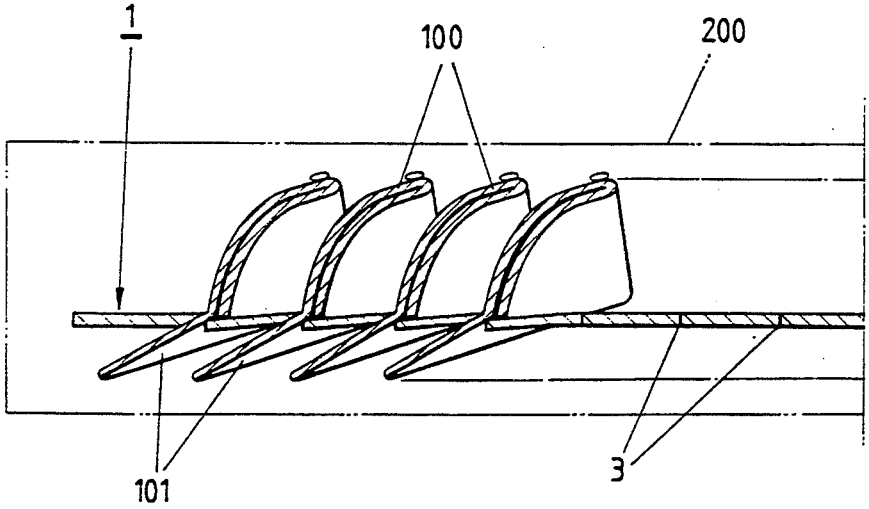
FIG. 2 is an enlarged cross-sectional view of one side of the invention showing eyeshades of two-folded caps are lined up at half-arc-shaped cutting portions.

This invention is composed of many half-arc-shaped cutting portions or tongues (3) on the surface of a packaging pad (1); small holes (4) installed at both ends of half-arc-shaped cutting portions (3); and a supporting hole (2) at one side of the packaging pad (1) with half-arc-shaped cutting portions (3) to which eyeshades (101) of the caps (100) are fixedly lined up. The cutting portion or tongues (3) are inwardly flexible and are formed by a plurality of slits (6), each of the slits (6) also forming a tongue edge (7) and a pad edge (8). Reference Numeral 200 in FIG. 2 refers to a packaging box.

Figure 3:
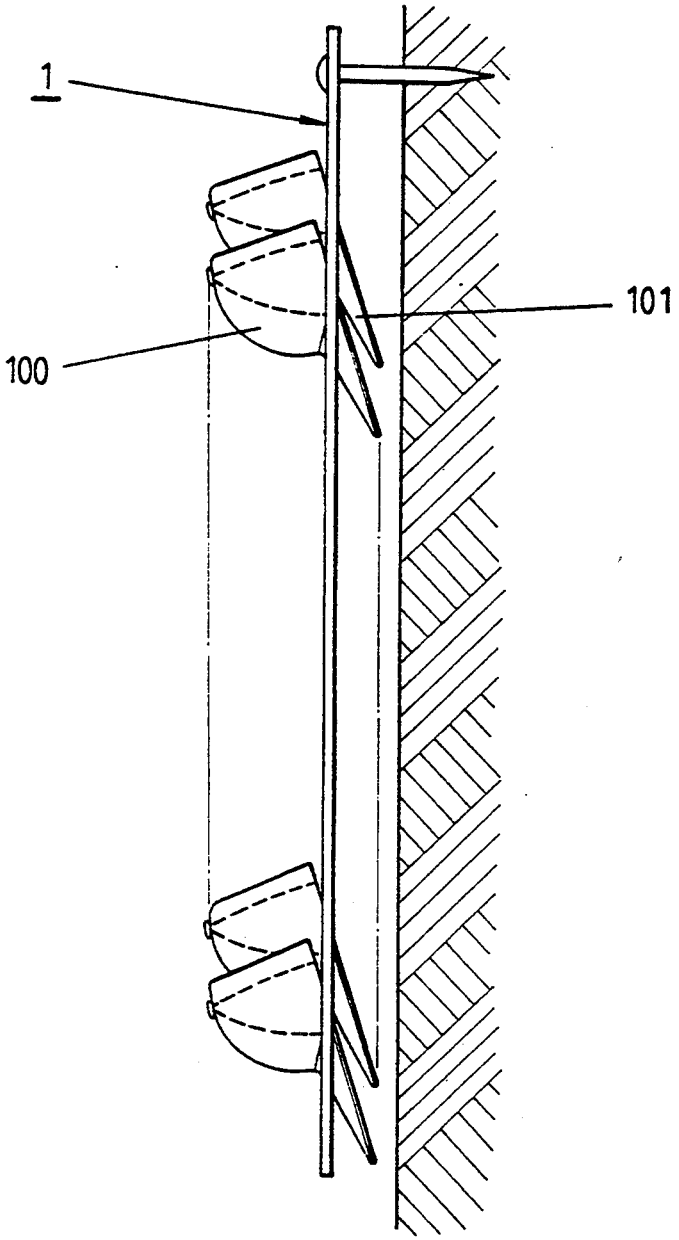
FIG. 3 is a side view of the invention showing a packaging pad on the wall with many caps lined up.

The shape of an arc of a half-arc-shaped cutting portion formed on a packaging pad (1) is determined according to the size and degree of curve of eyeshades (101) to be fixed; small holes (4) are installed in order to prevent ripping-off of the end portions of half-arc-shaped cutting portions (3) when eyeshades (101) are fixed at the cutting portions (3); and fixing eyeshades (101) of the two-folded caps (100) at half-arc-shaped cutting portions (3) formed on a packaging pad (1) (Refer to FIGS. 2 and 3) enables prevention of scattering or wrinkles of the caps (100) in a packaging box (200).

The packaging pad (1) in this invention is made of highly elastic synthetic resin in the form of a thin plate.

Packaging process of the caps can be improved because a large number of the caps (100) are packed in a unit. Also, when a packaging pad (1) is used as a packaging medium, eyeshades (101) of the caps (100) firmly fixed at half-arc-shaped cutting portions (3) are not easily removed because of outside impact, etc.; and problems in packing caps in a packaging box (200), such as scattering or wrinkles of the caps in a packaging box (200), can be completely solved. Therefore, the present invention is thought to have novelty and usefulness.

What is claimed is:

1. In combination, a plurality of caps and a packaging pad for transporting and displaying said caps, the caps including a collapsible main body and a planar eyeshade having a specified width, the planar eyeshade provided with a curved edge connected to a corresponding curved edge of the main body to form a junction, the packaging pad comprising:

a) a planar pad made from an elastic resin material;

b) a first row of apertures formed in said pad, the apertures positioned in spaced-apart relationship;

c) a second row of apertures formed in said pad in parallel relationship to said first row of apertures, said first row of apertures including apertures aligned directly across from a corresponding aperture in said second row of apertures to form a plurality of parallel pairs of apertures, said first and second rows, and the apertures forming a pair, being spaced apart a distance equal to the approximate width of the eyeshade; and d) a plurality of curved slits cut in said planar pad, each slit extending from an aperture in said first row in a curved path to a corresponding parallel pair aperture in said second row to form a tongue edge, a pad edge, and an inwardly flexible tongue, whereby a cap is retained by flexing the tongue inward, sliding the eyeshade through the slit, and releasing the tongue such that the cap is secured between the tongue edge and the pad edge at the approximate junction of the eyeshade and main body of the cap.

2. The combination defined in claim 1 wherein the curved path of each slit is formed with a shape corresponding to the curved edge of the eyeshade at the junction with the main body of the cap.

3. The combination defined in claim 1 including a means for securing said planar pad to a wall for display.

4. The combination defined in claim 3 wherein said means for securing said planar pad includes an aperture adjacent an edge of said planar pad.

* * * * *